United States Patent [19]

Best

[11] 4,449,016

[45] May 15, 1984

[54] CERAMIC HEATER SUPPORT AND SPACER BLOCK

[75] Inventor: Lorne A. Best, West Bloomfield, Mich.

[73] Assignee: National Element, Inc., Troy, Mich.

[21] Appl. No.: 330,101

[22] Filed: Dec. 14, 1981

Related U.S. Application Data

[62] Division of Ser. No. 227,434, Jan. 22, 1981, Pat. No. 4,337,390.

[51] Int. Cl.[3] ..... H01B 17/56

[52] U.S. Cl. ..... 174/138 J; D13/18

[58] Field of Search ..... 174/137 R, 138 R, 138 J, 174/152 G, 155, 156, 157, 163 R, 164, 166 R, 174, 212; 219/375, 532, 550, 536, 542, 546, 548; 338/299, 304, 305, 315, 318, 321, 279–286, 289, 290, 317; D13/17, 18; 373/128–131, 134

[56] References Cited

U.S. PATENT DOCUMENTS

| | | | |
|---|---|---|---|
| 554,723 | 2/1896 | Peloubet | 174/155 X |
| 947,094 | 1/1910 | Burton | 174/155 |
| 2,424,008 | 7/1947 | Wayman | 174/155 |

*Primary Examiner*—Laramie E. Askin

*Attorney, Agent, or Firm*—Cullen, Sloman, Cantor, Grauer, Scott & Rutherford

[57] ABSTRACT

An improved ceramic heater support and spacer block, for use in an electrical heating element, is constructed to increase the amount of electrical wire per unit space available for plug-type conventional heating units. The ceramic heater support block, T-shape in plan, has spaced end faces and a groove in its under surface extending between and perpendicular to the end faces which receives a crossbar interposed between support elements. Each block has a support boss of a width adapted to extend between the strands of a section of heating wire. Each block has a pair of spacer bosses, adjacent to its other end face, which extend laterally outward of the support boss. Each heating wire section of a group is mounted upon the support boss of each block, upon a crossbar, with the spacer bosses extending between and outward of adjacent sections. The one strand of adjacent heating wire sections is transversely interconnected below a row of support blocks mounted upon an adjacent crossbar.

1 Claim, 6 Drawing Figures

CERAMIC HEATER SUPPORT AND SPACER BLOCK

This application is a division of application Ser. No. 227,434, filed Jan. 22, 1981, now U.S. Pat. No. 4,337,390.

BACKGROUND OF THE INVENTION

The plug-type heating elements of the prior art consist of a series of metal rectangular sections which have an insulator on each side of each section at a plurality of spaced locations along the length of the section. The electrical heating wire is wound around each of the spacers, down one side of the frame and back up the opposite side of the frame.

One problem with the prior art heating element construction involves the space taken up by each frame member. The space interferes with the flow of air through the plug unit. In other words, the heating elements, when electrically connected, provide a source of heat with the flow of air passing through and around the heating elements determining the quantity of heat emitted from the plug unit. If air flow is restricted by metal frame sections, the kilowatt output per unit area will be decreased causing loss of efficiency. Likewise, the use of multiple frame sections for a plug unit results in a large percentage of the physical space being occupied which otherwise could be used for heating elements.

Another problem of the prior art is that the insulators, attached to the frame sections, are difficult to remove and each insulator must be removed from the frame section separately in order to change wire spacing or otherwise repair the plug units. Additionally, the cost of construction, necessitated by the multiple frame sections and the attachment of each individual insulator to the frame sections, increases with the cost of materials for the frames and insulators, as well as the labor involved in assembling a plug unit.

This invention is an improvement in the electric heating element disclosed in my earlier U.S. patent application Ser. No. 20,594, filed Mar. 14, 1979, now U.S. Pat. No. 4,243,872, issued Jan. 6, 1981.

SUMMARY OF THE INVENTION

The present invention is a support and spacer block for use in an electrical heating element used primarily for plug-type convection heaters. A frame support structure consisting of parallel spaced support elements has a plurality of spaced crossbars extending from one side of the frame structure to the other. The support elements and crossbars provide the boundaries for a continuous heating wire. Specifically, the invention pertains to a ceramic support and spacer block having a pair of spaced end faces and, across its undersurface, an elongated groove which extends between the end faces to facilitate removal from and mounting of the block upon a crossbar. The block includes a wire element support boss of a width adapted to extend between the strands of a single inverted U-shaped section of the heating wire. Each ceramic block includes a pair of spacer bosses which extend laterally from the support boss and between adjacent sections of the heating wire.

The support and spacer block of the present invention provides an improvement in the power density input and output to the plug-type heater. As many ceramic blocks as practical can be inserted between the sides of the frame eliminating air flow resistance, and reducing pressure drop from one end of the frame to the other. This reduction in pressure drop allows the air flow to be more continuous and permits a greater output of heated air from the plug unit.

The ceramic combination support and spacer blocks mounted on the crossbars allow for ease of assembly and repair. The blocks may simply be lifted off the crossbars individually, without interference to adjacent blocks and without removal of the crossbar.

The simplicity of construction and ease with which the ceramic spacer support blocks are able to be changed permits the stacking of several rows of blocks without inhibiting air flow. The present invention also provides for reduced cost in the production of plug-type heaters due to a time savings achieved because there is no requirement that each individual support block be fastened to the crossbars of the frame structure. Further, the individual wire sections of the heating wire do not have to be tied to the insulator blocks as in my earlier application.

These and other objects and features will be seen from the following detailed description and claims in conjunction with the appended drawings.

It should be understood that the drawings illustrate merely a preferred embodiment of the invention and that other embodiments are contemplated within the scope of the claims hereafter set forth.

DETAILED DESCRIPTION OF AN EMBODIMENT OF THE INVENTION

Figure 1:
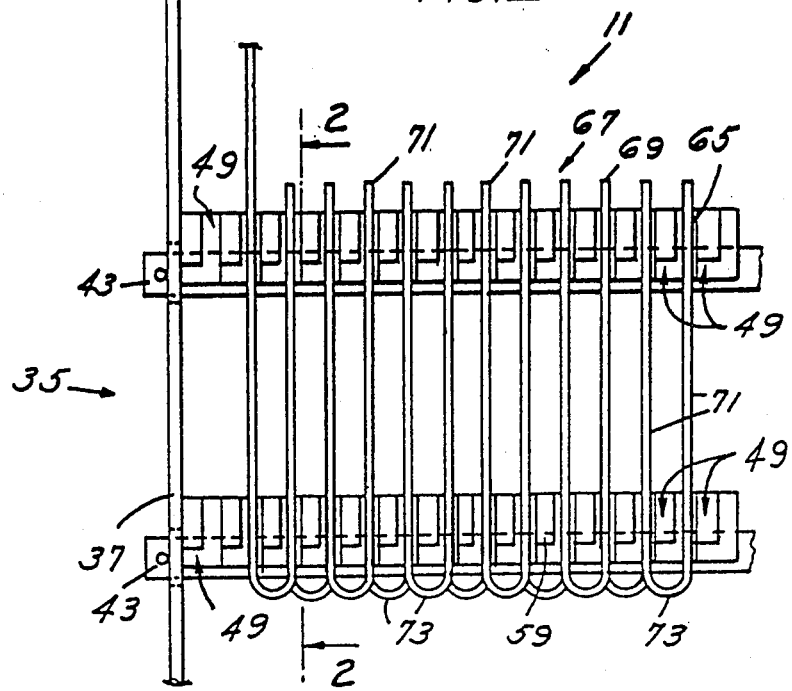
FIG. 1 is a fragmentary side view of a portion of the frame structure illustrating the mounting of part of one group of inverted U-shaped heater or wire sections.

Referring to the drawings, the present heater support and spacer blocks used in an electrical heating element 11 for a plug-type convection heater are generally indicated at 49, FIG. 1. A frame or frame structure 35 is of generally rectangular shape constructed of metal, is open at its ends, and has a central longitudinal axis. The frame 35 consists of parallel spaced support elements 37 and a plurality of spaced crossbars 43 extending from one side of the frame structure to the other.

While FIG. 1 illustratively shows a pair of supports or crossbars 43 as making up part of the frame structure 35, the continuous electric resistance heating wire 67 is made up of a series of groups of upright parallel spaced inverted U-shaped wire sections 69. For any particular group, the wire sections 69 are arranged between a pair of adjacent crossbars 43 supportively mounted by the upper of the crossbars 43, FIG. 2. The wire sections 69 are spaced and retained, with respect to the lower of the crossbars 43, by the combination heater support and spacer blocks 49 made from ceramics, FIGS. 3 through 6.

Each of the heater support and spacer blocks 49 includes a unitary body 51 of generally T-shaped configuration and made from a ceramic material. The body 51 has a pair of opposed, parallel and spaced apart end faces 55, 63, FIG. 6, and is symmetrical about a central plane 50 which is perpendicular to the end faces 55, 63. The body 51 includes a support boss 57 extending on opposite sides of the central plane 50. The support boss 57 extends between and includes the end faces 55, 63.

Figure 3:
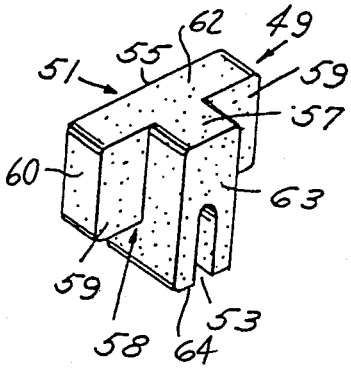
FIG. 3 is a perspective view of the present combination ceramic support and spacer block.

The body 51 further includes a pair of spacer bosses 59 which project in opposite directions laterally outwardly from the support boss 57 as best shown in FIG. 3 and terminate in side faces 60.

Figure 2:
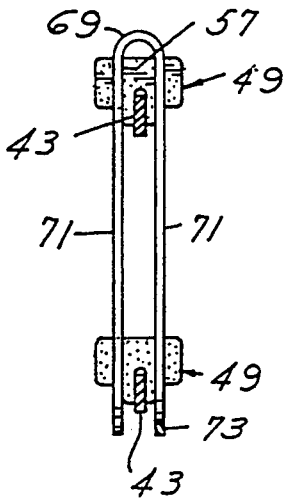
FIG. 2 is a fragmentary section taking the direction of arrows 2—2 of FIG. 1.

The support boss 57 has a width measured in a direction perpendicular to the central plane 50 which is less than the distance between the side faces 60 of the spacer bosses 59. The body 51 including the support boss 57 and the spacer bosses 59 has a top face 62 of T-shaped configuration. The support boss 57 has a bottom face 64 of generally rectangular configuration parallel to and spaced from the top face 62. The bottom face 64 is provided with an undercut slot or a generally elongated horizontal groove 53 which extends between and is perpendicular to the end faces 55, 63. The heater support and spaced block 49 is adapted to be mounted on the support 43 by inserting the block 49 over a corresponding crossbar 43 as shown in FIG. 2. The support boss 57 is adapted to supportively mount one inverted U-shaped section 69 of the electric heating wire 67.

Figure 4:
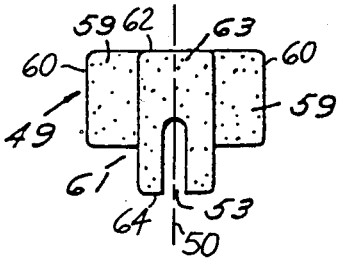
FIG. 4 is an end elevational view thereof.
Figure 5:
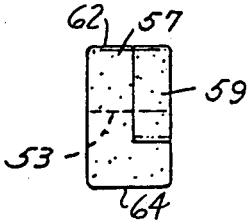
FIG. 5 is a right side elevational view of the block shown in FIG. 4.
Figure 6:
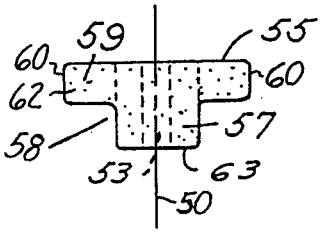
FIG. 6 is a plan view of the block shown in FIG. 4.

The pair of spacer bosses 59 are of the same height measured in a direction parallel to the central plane 50. The height of the spacer bosses 59 is less than the height of the support boss 57 as shown in FIGS. 3 and 4. The spacer bosses 59, adjacent end face 55, are of reduced height with respect to support boss 57 and define with support boss 57 a clearance recess 58, FIG. 3, and below the spacer bosses 59, clearance recesses 61, FIG. 4.

The respective insulating ceramic support and spacer blocks 49 are mounted end to end and aligned upon and along the crossbars 43 with the grooves 53, of the blocks 49, receiving the crossbars 43. The support blocks 49 extend end to end in one direction along the length of the respective crossbar 43. In some applications the blocks 49 could face in the same direction along each crossbar 43. This arrangement provides a segmented, insulated support for a group of heating wire sections 69 such as shown in FIGS. 1 and 2.

The support blocks 49 are arranged end to end with the end face 63 of one block 49 bearing against an adjacent end face 55 of another block 49. This defines, between adjacent pairs of spacer blocks 49, a series of upright clearance recesses 65, FIG. 1, between the respective support blocks 49. These recesses 65 loosely receive the corresponding strands 71 of each of the individual inverted U-shaped wire sections 69. These sections 69 are arranged in parallel spaced relation to a first plane. A plurality of the interconnected wire sections 69 make up a unit group.

The strands 71, of each U-shaped section 69, are joined by U-shaped connectors 73 at their lower ends, FIG. 1, with the connections between adjacent sections 69 being alternated between a pair of parallel planes through strand 71 which extends at right angles to the plane of the individual U-shaped section 69.

The respective row of ceramic support blocks 49 is mounted upon a particular crossbar 43. Each row defines a segmented insulated support for the series of spaced inverted U-shaped wire sections 69 making a single group. If, in the present construction, it is desirable to remove or replace one or more of the individual heater support and spacer blocks 49, this can be done without disconnecting the corresponding crossbars 43, or without interferring with any other support block 49, by merely lifting out an individual support block 49. Once an insulator block 49 is cracked, chipped or broken, it can be replaced in the novel manner indicated.

I claim:

1. A heater support and spacer block adapted for mounting on a support for spacing and retaining an electric resistance heating wire primarily for use in a plug-type convection heater comprising:

a ceramic unitary body having opposed, parallel and spaced apart end faces and being symmetrical about a central plane perpendicular to said end faces;

said body including a support boss extending on opposite sides of the central plane, and extending between and including said end faces;

said body including a pair of spacer bosses which project in opposite directions laterally outwardly from said support boss and terminate in side faces which are spaced from the aforesaid central plane;

said support boss having a width measured in a direction perpendicular to the central plane which is less than the distance between the side faces of said spacer bosses;

said body including said support boss and said spacer bosses having a top face of T-shaped configuration and said support boss having a bottom face of generally rectangular configuration parallel to and spaced from said top face;

said spacer bosses having end surfaces in the plane of one of said end faces;

said spacer bosses being of the same height measured in a direction parallel to the central plane which is less than the height of said support boss;

and an elongated groove in the bottom face of said support boss extending between and being perpendicular to said end faces.

* * * * *